US008221185B2

(12) United States Patent
Tome

(10) Patent No.: US 8,221,185 B2
(45) Date of Patent: Jul. 17, 2012

(54) METHOD OF USE OF DECORATIVE CHRISTMAS TREE BASE AND ASSEMBLAGE

(76) Inventor: Dorothy Tome, Hypoluxo, FL (US)

( * ) Notice: Subject to any disclaimer, the term of this patent is extended or adjusted under 35 U.S.C. 154(b) by 125 days.

(21) Appl. No.: 13/025,996

(22) Filed: Feb. 11, 2011

(65) Prior Publication Data

US 2011/0136403 A1 Jun. 9, 2011

Related U.S. Application Data

(63) Continuation-in-part of application No. 12/383,481, filed on Mar. 26, 2009.

(51) Int. Cl.
*A63H 33/26* (2006.01)

(52) U.S. Cl. ..... 446/485; 362/123; 362/654; 428/18; 428/19

(58) Field of Classification Search ..... 446/485; 362/253, 249.06, 249.11, 249.07, 123, 654; 428/18, 19
See application file for complete search history.

(56) References Cited

U.S. PATENT DOCUMENTS 1,707,539 A * 4/1929 Propp ..... 108/23
1,971,300 A * 8/1934 Garrett ..... 248/522
1,971,612 A * 8/1934 Kidwell ..... 446/118
2,113,038 A * 4/1938 Thalinger ..... 428/7
2,223,222 A * 11/1940 Morrison ..... 446/91
2,477,981 A * 8/1949 Havery ..... 47/40.5
2,874,496 A * 2/1959 Rakes ..... 40/457
5,213,519 A * 5/1993 Dorfman ..... 439/505
5,911,633 A * 6/1999 Sofy et al. ..... 47/40.5
5,915,853 A * 6/1999 Guilin ..... 40/414
6,041,545 A * 3/2000 Sofy et al. ..... 47/40.5
6,523,968 B1 * 2/2003 Walker ..... 362/103
2001/0043472 A1 * 11/2001 Gibboney, Jr. ..... 362/240

* cited by examiner

*Primary Examiner* — Gene Kim
*Assistant Examiner* — Matthew B Stanczak
(74) *Attorney, Agent, or Firm* — Robert J. Van Der Wall

(57) ABSTRACT

The invention is a method of use of an assemblage of a electrified base member having a plurality of perforations holding an array of sockets for light sources for optional lighting of the interior of various miniature buildings, a white cover material to simulate snow and a plurality of figurines of people and animals. The method employs a large combination of apparatus features including various miniature buildings that constitute a village surrounded by a white picket fence protecting the display from being dislodged by gifts under or near the tree, and, optionally a model train set with a train station, a plurality of miniature buildings such as a post office, bank, church, fire station, police station, and train station of sufficient number and variety to constitute a village, an ice skating rink with moving magnetic figures constituting skaters, all or any number of which can be placed in a infinite variety of locations by the owner, a multiplicity of figurines constituting villagers and optionally the characters of a nativity scene with a manger, angels, choristers, wise men, shepherds, sheep, camels, cattle, dogs and cats, all or any number of which can also be placed in a infinite variety of locations by the owner.

8 Claims, 4 Drawing Sheets

METHOD OF USE OF DECORATIVE CHRISTMAS TREE BASE AND ASSEMBLAGE

CROSS REFERENCE TO ANOTHER APPLICATION

This application is a continuation. in part of a co-pending parent application, Ser. No. 12/383,481 filed Mar. 26, 2009. It claims the filing date of Mar. 26, 2009 as to the common subject matter.

BACKGROUND OF THE INVENTION

1. Field of the Invention

The present invention relates to the field of functional and decorative Christmas tree accessories. More specifically, it concerns a method of use of an assemblage of a electrified base member having a plurality of perforations holding an array of sockets for light sources for optional lighting of the interior of various miniature buildings, a white cover material to simulate snow and a plurality of figurines of people and animals. The light sources can be light bulbs, light emitting diodes (LED's) or the like.

The unique feature of the invention relates to the infinite variety achievable in the arrangement of the illuminated buildings and the figurines. This unique feature of infinite variety is the core of the present inventive method. Beneath the foregoing elements is a Christmas tree stand that supports the tree in a vertical posture. The cover material has at least two functions, i.e., to cover and camouflage the Christmas tree stand, and to provide an attractive surface on which is placed the miniature buildings and figurines with the key feature being that the cover material preferably includes a plurality of slits through which can be inserted light sources placed in selected sockets in the electrified base member to light the interiors of various miniature buildings placed on top of the cover material. The fact that the openings in the cover material are slits is very important because they close of their own volition to hide the sockets that are not being used.

The inventive method contemplates the selection of which miniature buildings will be used for a given Christmas season, selecting the locations where they will be placed, putting light sources through slits in the cover material that are positioned over every socket, placing the miniature buildings over the light sources so each such building can optionally be illuminated, selecting the figurines to be used for a given Christmas season, selecting the locations where they will be placed, and placing the figurines where desired. One of the options is a nativity scene in which may be included baby Jesus, Mary and Joseph, shepherds, wise men, angels, and various animals such as camels, sheep, cattle, domesticated animals, and the like.

2. Description of the Prior Art

Christmas trees have been a part of the Christmas holiday celebration for more than one hundred years. Originally, all Christmas trees were live trees that were cut down in the forest and brought indoors for the holiday period. This necessitated a means to hold the live tree in a vertical configuration and suggested a means to protect the interior flooring or carpet from tree sap, pine needles and other live tree droppings. In recent decades, artificial trees have become available and popular, but these also frequently use a separate structure to hold the tree in a vertical configuration. These structures are generally termed Christmas tree stands. Often they can be used with both live and artificial trees, and so they frequently contain a reservoir for water to immerse the stump of a live tree to help keep the tree fresh.

Christmas tree stands are generally unattractive structures, especially since many of them are designed to accommodate varying tree diameters such as occurs with live trees. The varying diameters require adjusting screws or the like that often project outward from the structure. Some of the prior art has the objective of hiding or disguising the Christmas tree stand. Examples of this are Taylor, U.S. Pat. No. 4,061,306 for a Decoration Platform Assembly; and Sofy et al., U.S. Pat. No. 6,041,545 for a Decorative Surround for Display Stand. Sometimes such prior art structures are accompanied by other decorative features such electrified or static display model trains and structures. Examples are Sofy et al., U.S. Pat. No. 6,041,545 for a Decorative Surround for Display Stand; Chapin, U.S. Pat. No. 5,131,618 for an Elevated Christmas Tree Track; and Cummings, U.S. Pat. No. 5,211,366 for an Ornamental Support for Christmas Tree and the Like.

Examination of the parent application on the subject matter of the present application revealed additional prior art. That prior art is as follows: Schroeder, U.S. Pat. No. D326,522, for a Christmas Tree Village Base, Rakes, U.S. Pat. No. 2,874,496, for a Display, Macedonic, U.S. Pat. No. 6,783,259, for an Apparatus For Recreating And Illuminating a Visual Image, Chin at al, U.S. Patent Application Publication No. 2007/0253191 for a Revolving Christmas Tree With Articulating Branches, Fegley at al, U.S. Pat. No. 1,900,807 for a Christmas Tree Holder, Guilin, U.S. Pat. No. 5,915,853 for a Magnet Drive System For an Animated Display, and Cheng, U.S. Patent No. 2007/0121321 for a Decorative Light System.

No prior art known to Applicant includes the particular combination of features of the present inventive method. The method uses the following apparatus: an electrified base member with a plurality of perforations having an array of sockets for light sources for optional lighting of various miniature buildings being surrounded by a white picket fence protecting the display from being dislodged by gifts under or near the tree, use of a white cotton padding cover simulating snow covering the Christmas tree stand. The foregoing include the functional objective of protecting the flooring or carpeting from tree sap and other tree dropping.

Other apparatus used with the inventive method, include optionally a model train set that is preferably placed around the outside of the village white picket fence, a nativity scene, a plurality of miniature buildings such as houses, a post office, bank, church, fire station, and police station of sufficient number and variety to constitute a village, and an optional ice skating of the large selection of same.

It is a further object of the invention to surround the invention with a white picket fence to protect the positioning of the components of the apparatus of the invention from intrusion by gifts under the Christmas tree.

It is another object of the invention to employ a base containing a plurality of perforation holding an array of sockets for lighting sources for optional lighting of various miniature buildings in an infinite variety of locations.

It is a related object of the invention to accomplish the foregoing objectives with an apparatus that camouflages the Christmas tree stand.

Other objects and advantages of the present invention will be apparent to those skilled in the art upon review of the following descriptions and appended drawings.

In accordance with a primary aspect of the invention, there is provided a method of use of an assemblage of a electrified base member having a plurality of perforations holding an array of sockets for light sources for optional lighting of the interior of various miniature buildings, a white cover material to simulate snow and a plurality of figurines of people and animals. The method employs a large combination of apparatus features including an electrified base member with a plurality of perforations having an array of sockets for light sources for optional lighting of various miniature buildings being surrounded by a white picket fence protecting the display from being dislodged by gifts under or near the tree, use of a white cotton padding cover simulating snow covering the Christmas tree stand, optionally a model train set with a train station, a plurality of miniature buildings such as a post office, bank, church, fire station, police station, and train station of sufficient number and variety to constitute a village, an ice skating rink with moving magnetic figures constituting skaters, all or any number of which can be placed in a infinite variety of locations by the owner, a multiplicity of figurines constituting villagers and optionally the characters of a nativity scene with a manger, angels, choristers, wise men, shepherds, sheep, camels, cattle, dogs and cats, all or any number of which can also be placed in a infinite variety of locations by the owner.

BRIEF DESCRIPTION OF THE DRAWINGS

Various other features of the invention will become apparent to those skilled in the art from the following discussion taken in conjunction with the appended drawings, in which.

DETAILED DESCRIPTION OF THE PREFERRED EMBODIMENTS

Figure 1:
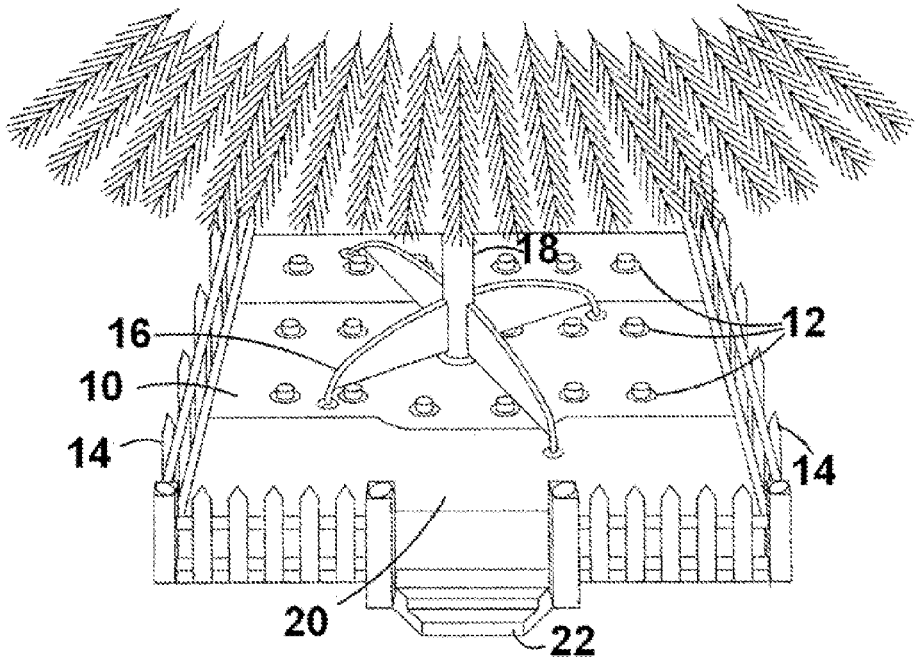
FIG. 1 is a perspective view of the electrified base member having the plurality of sockets, surrounding white picket fence, Christmas tree stand into which has been placed the Christmas tree trunk.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structures.

Reference is now made to the drawings, wherein like characteristics and features of the present invention shown in the various figures are designated by the same reference numerals.

FIG. 1 is a perspective view of the electrified base member 10 having the plurality of sockets 12, surrounding white picket fence 14, Christmas tree stand 16 into which has been placed the Christmas tree trunk 18. In the front is the white picket fence opening 20 and stairs 22.

Figure 2:
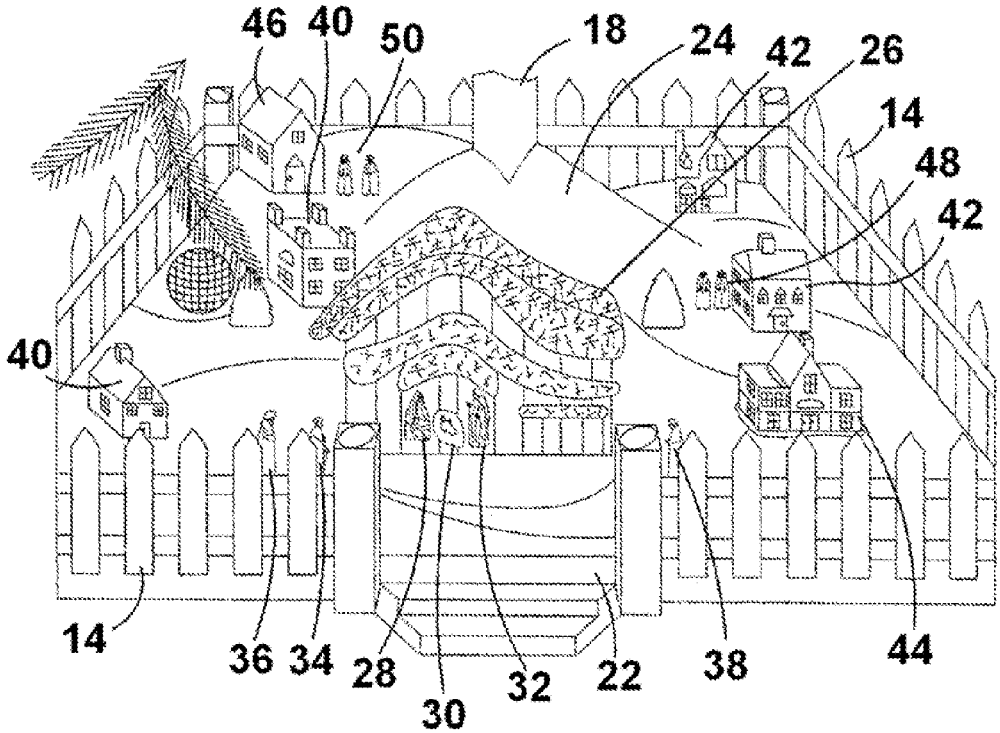
FIG. 2 is a perspective closeup view showing the cover material camouflaging the Christmas tree stand and one of the infinite number of options in the placement of miniature buildings and figurines, featuring the nativity scene and related figures in the front center right above the stairs.

FIG. 2 is a perspective closeup view showing the cover material 24 camouflaging the Christmas tree stand 16 and one of the infinite number of options in the placement of miniature buildings and figurines features the nativity scene 26 in the front center directly above the stairs 22. The nativity scene includes Mary 28, baby Jesus 30, Joseph 32, and, wise men 34, 36, and 38. Also seen are village houses 40 and 42, and a plurality of other miniature buildings 44 and 46 that may be any of the following post office, bank, church, fire station, and police station. Also visible are choristers 48 and villagers 50. The skating rink, model train set and train station are not shown, but would preferably be placed outside of the white picket fence 14.

Figure 3:
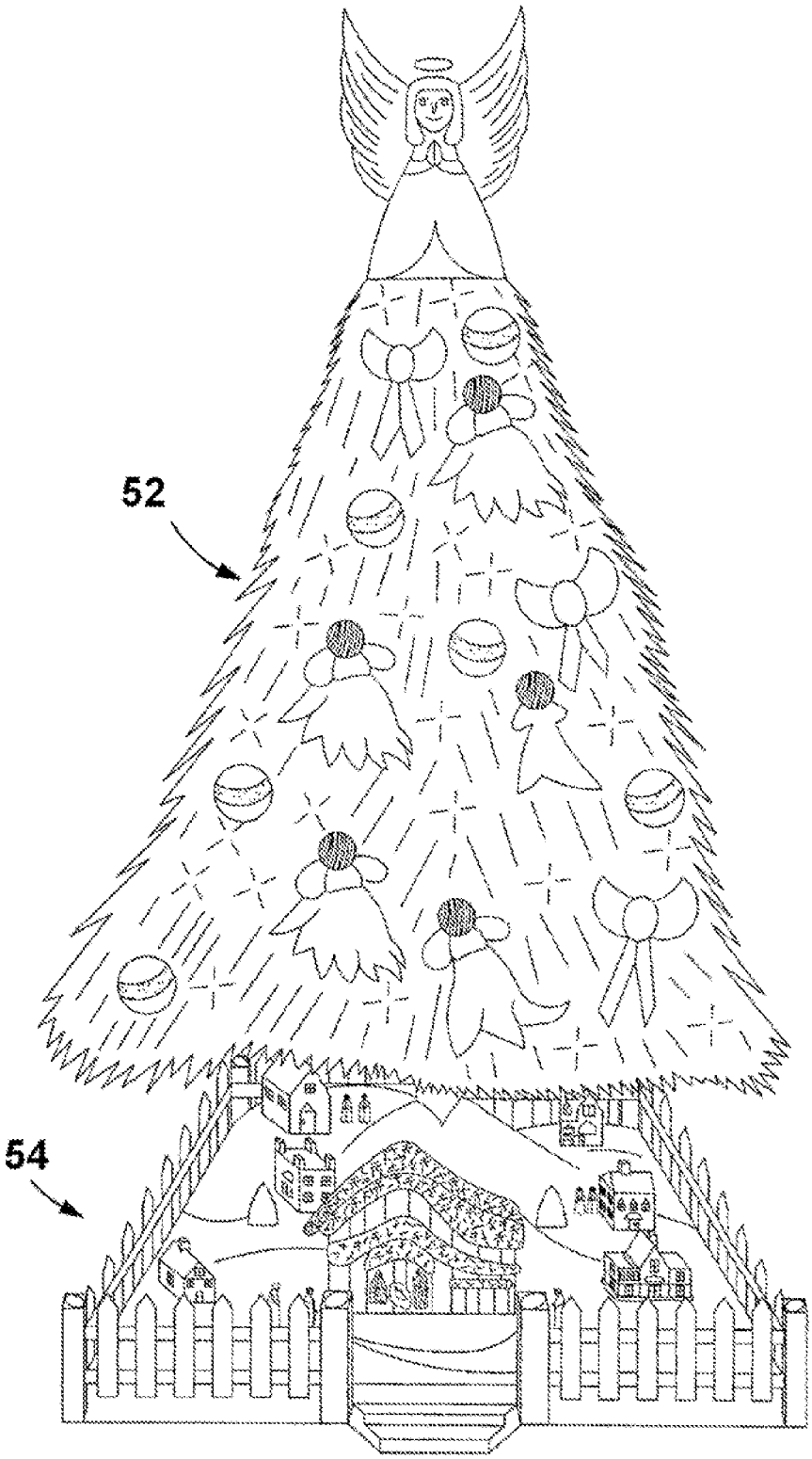
FIG. 3 is a perspective view showing the fully decorated Christmas tree above the completed inventive decorative and protective Christmas tree base and assemblage.

FIG. 3 is a perspective view showing the fully decorated Christmas tree 52 above the completed inventive decorative and protective Christmas tree base and assemblage 54.

Figure 4:
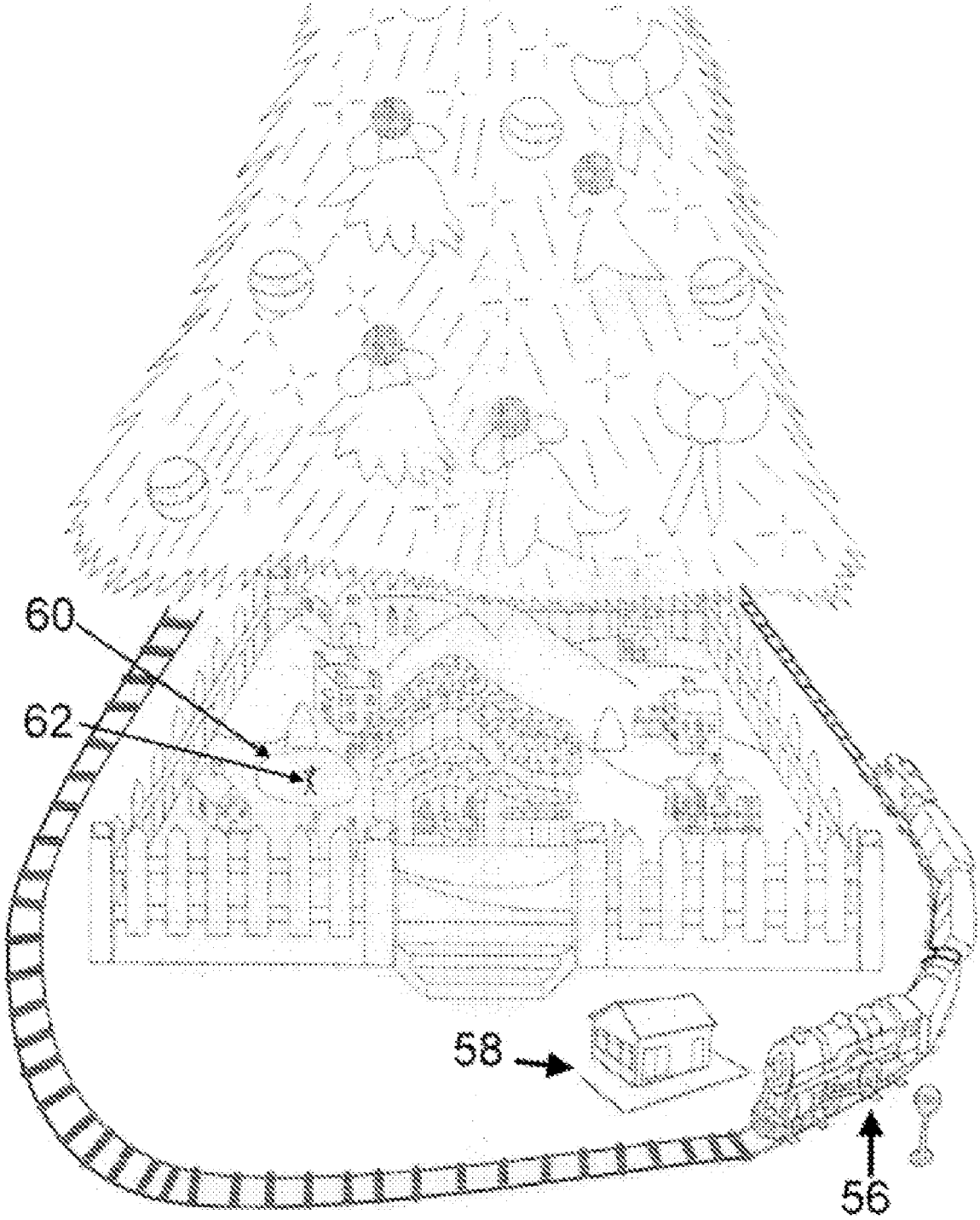
FIG. 4 shows the addition of the optional features of a model train set with train station surrounding the white picket fence and a simulated ice skating rink with moving magnetic skaters.

FIG. 4 is a reduced size copy of a FIG. 3, but showing the addition of optional features of a model train set 56 with train station 58 and a simulated ice skating rink 60 with moving magnetic skaters 62.

Figure 5:
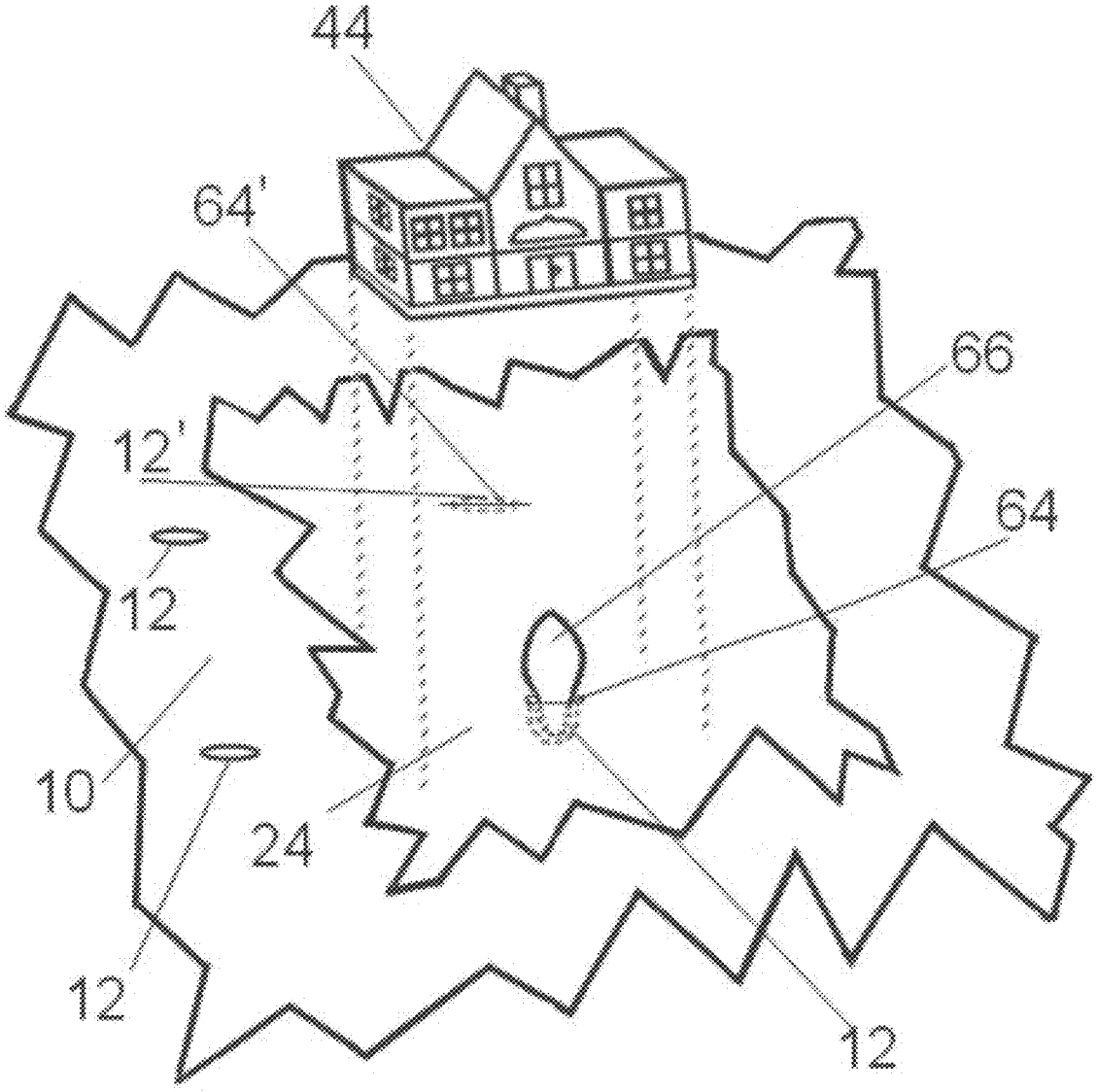
FIG. 5 is a broken perspective exploded view showing how a light source is inserted through a slit in the cover material and placed underneath one of the miniature structures.

FIG. 5 is a broken perspective exploded view showing how a light source 66 is inserted into a socket 12 in electrified base member 10 through a slit 64 in cover material 24 upon which is lowered a miniaturized structure 44. Of note is the fact that a slit 64' in cover material 24 over socket 12' that is not being used remains closed and therefore essentially invisible because it was not selected to illuminate any structures. On the other hand, slit 64 through which inserted light source 66 is shown open but is invisible upon assembly because miniature structure 44 is lowered thereover so that the opening in cover material 24 is not seen because it is covered by miniature structure 44 when the latter is lowered in place.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method of use of a decorative Christmas tree base and assemblage comprising:

disposing in a rigid and appropriate position an electrified base member having an array of sockets permanently fixed in location with respect to each other and within the electrified base member and suitable for powering light sources;

selecting which of a multiplicity of miniature buildings will be used for a given Christmas season;

selecting the locations where each of the selected miniature buildings are being positioned;

determining which of the selected miniature buildings are to be illuminated;

placing light sources through slits in a cover material that are positioned over sockets that correspond to the locations selected for miniature buildings to be illuminated and making electrical connections between the light sources and the sockets;

positioning the miniature buildings in the locations selected including placing the miniature buildings over light sources for those determined to be illuminated;

selecting the figurines to be used for a given Christmas season;

selecting the locations where they will be placed; and placing the figurines in the locations selected.

2. The method of claim 1 which further comprises powering up the light sources inside the miniature buildings determined to be illuminated.

3. The method of claim 1 which further comprises surrounding the decorative Christmas tree base and assemblage with a white picket fence having a front opening and steps up to the assemblage.

4. The method of claim 3 which further comprises surrounding the white picket fence with a model train set.

5. The method of claim 1 which further comprises adding to the assemblage a simulated ice skating rink with moving magnetic skaters.

6. The method of claim 1 in which selecting miniature building includes selecting from such items as a nativity scene, houses, a post office, bank, church, fire station, and police station of sufficient number and variety to constitute a village.

7. The method of claim 1 in which selecting figurines includes selecting from such items as villagers, nativity characters such as baby Jesus, Mary, Joseph, wisemen, shepherds, angels, choristers, sheep, cattle, camels, horses, dogs, and cats of sufficient size to allow an infinite variety of selection and placement of the miniature buildings and figurines.

8. The method of claim 1 in which the arrays of sockets and the corresponding slits in the cover material are of sufficient number to allow an infinite variety of selection and placement of the miniature buildings and figurines.

* * * * *